US012281878B2

(12) United States Patent
Knyazev et al.

(10) Patent No.: US 12,281,878 B2
(45) Date of Patent: Apr. 22, 2025

(54) COORDINATION OF PULSE REPETITION FREQUENCY (PRF) CODES IN LASER-GUIDED APPLICATIONS

(71) Applicant: Raytheon Company, Waltham, MA (US)

(72) Inventors: Dmitry V. Knyazev, Tucson, AZ (US); James P. Henderson, Sahuarita, AZ (US); Jeremy J. Radtke, Oro Valley, AZ (US)

(73) Assignee: Raytheon Company, Arlington, VA (US)

( * ) Notice: Subject to any disclaimer, the term of this patent is extended or adjusted under 35 U.S.C. 154(b) by 733 days.

(21) Appl. No.: 17/404,747

(22) Filed: Aug. 17, 2021

(65) Prior Publication Data

US 2023/0056587 A1 Feb. 23, 2023

(51) Int. Cl.
*F41G 7/00* (2006.01)
*F41G 7/22* (2006.01)

(52) U.S. Cl.
CPC ..... *F41G 7/007* (2013.01); *F41G 7/2246* (2013.01); *F41G 7/2293* (2013.01)

(58) Field of Classification Search
CPC ..... F41G 7/007; F41G 7/2293; F41G 7/2246; G06F 13/4081; G06F 21/123; G06F 9/4411; G06F 9/4413
See application file for complete search history.

(56) References Cited

U.S. PATENT DOCUMENTS

| | | | | |
|---|---|---|---|---|
| 5,023,888 | A | 6/1991 | Bayston | |
| 5,026,156 | A | 6/1991 | Bayston et al. | |
| 6,666,142 | B1 * | 12/2003 | Pearce | F42C 17/02 102/293 |
| 8,344,302 | B1 | 1/2013 | Murphy et al. | |
| 11,038,849 | B1 * | 6/2021 | Alm | H04L 63/0428 |
| 2005/0183570 | A1 * | 8/2005 | McMahon | F42C 15/40 89/1.811 |
| 2008/0022360 | A1 * | 1/2008 | Bacastow | G06F 21/85 726/16 |
| 2010/0217899 | A1 * | 8/2010 | Sitzmann | F41G 7/007 345/619 |
| 2012/0047368 | A1 * | 2/2012 | Chinn | G06F 21/57 726/19 |

(Continued)

OTHER PUBLICATIONS

"Joint Laser Designation Procedures (JLASER)", Join Pub 3-09.1, Jun. 1991, 120 pages.

*Primary Examiner* — Nimesh G Patel

(57) ABSTRACT

A method includes removably coupling a projectile interface of a dongle to a dongle interface of a projectile. The method also includes loading a dongle code from the dongle onto the projectile. The dongle code identifies a pulse repetition frequency (PRF) code to be recognized by the projectile. The dongle code may be unique to an operator of the projectile. The method may further include, prior to loading the dongle code onto the projectile, loading an operator code onto the projectile, where the dongle code is loaded onto the projectile in response to the projectile authorizing the operator code. There may be a limited number of uses of the dongle code with different projectiles, and/or there may be a limited amount of time for using the dongle code. A companion electronic device may be used to authenticate the dongle.

20 Claims, 3 Drawing Sheets

(56) References Cited

U.S. PATENT DOCUMENTS

| | | | | |
|---|---|---|---|---|
| 2012/0211665 | A1* | 8/2012 | Cloud | G01S 7/4804<br>250/394 |
| 2012/0312912 | A1* | 12/2012 | Murphy | F41G 7/007<br>398/130 |
| 2013/0070239 | A1* | 3/2013 | Crawford | G01S 3/784<br>356/139.04 |
| 2018/0107810 | A1* | 4/2018 | Kapolnek | G06F 21/123 |
| 2022/0108014 | A1* | 4/2022 | Schiffman | G06F 21/57 |

* cited by examiner

COORDINATION OF PULSE REPETITION FREQUENCY (PRF) CODES IN LASER-GUIDED APPLICATIONS

TECHNICAL FIELD

This disclosure relates generally to laser-guided devices and processes. More specifically, this disclosure relates to coordination of pulse repetition frequency (PRF) codes in laser-guided applications.

BACKGROUND

The dynamics of ground-to-ground laser-guided weapons applications pose a number of specific challenges that are not present in more traditional air-to-ground laser-guided weapons applications. For example, individual soldiers may require their own individual pulse repetition frequency (PRF) codes in order to deconflict their weapon designations from other soldiers' weapon designations. However, existing U.S. Air Force laser-guided weapon policies do not provide for such arrangements and include many other restrictions that make these policies impossible to use, despite the proliferating use of laser-guided weapons.

SUMMARY

This disclosure relates to coordination of pulse repetition frequency (PRF) codes in laser-guided applications.

In a first embodiment, a method includes removably coupling a projectile interface of a dongle to a dongle interface of a projectile. The method also includes loading a dongle code from the dongle onto the projectile. The dongle code identifies a PRF code to be recognized by the projectile.

In a second embodiment, a projectile assembly includes a projectile and a dongle. The projectile includes a dongle interface, and the dongle includes a projectile interface and a processor. The projectile interface is configured to be removably coupled to the dongle interface. The processor is configured to load a dongle code onto the projectile. The dongle code identifies a PRF code to be recognized by the projectile.

In a third embodiment, an apparatus includes a projectile interface and a processor. The projectile interface is configured to be removably coupled to a dongle interface of a projectile. The processor is configured to load a dongle code onto the projectile. The dongle code identifies a PRF code to be recognized by the projectile.

Other technical features may be readily apparent to one skilled in the art from the following figures, descriptions, and claims.

BRIEF DESCRIPTION OF THE DRAWINGS

For a more complete understanding of this disclosure, reference is made to the following description, taken in conjunction with the accompanying drawings, in which.

DETAILED DESCRIPTION

Figure 1A:
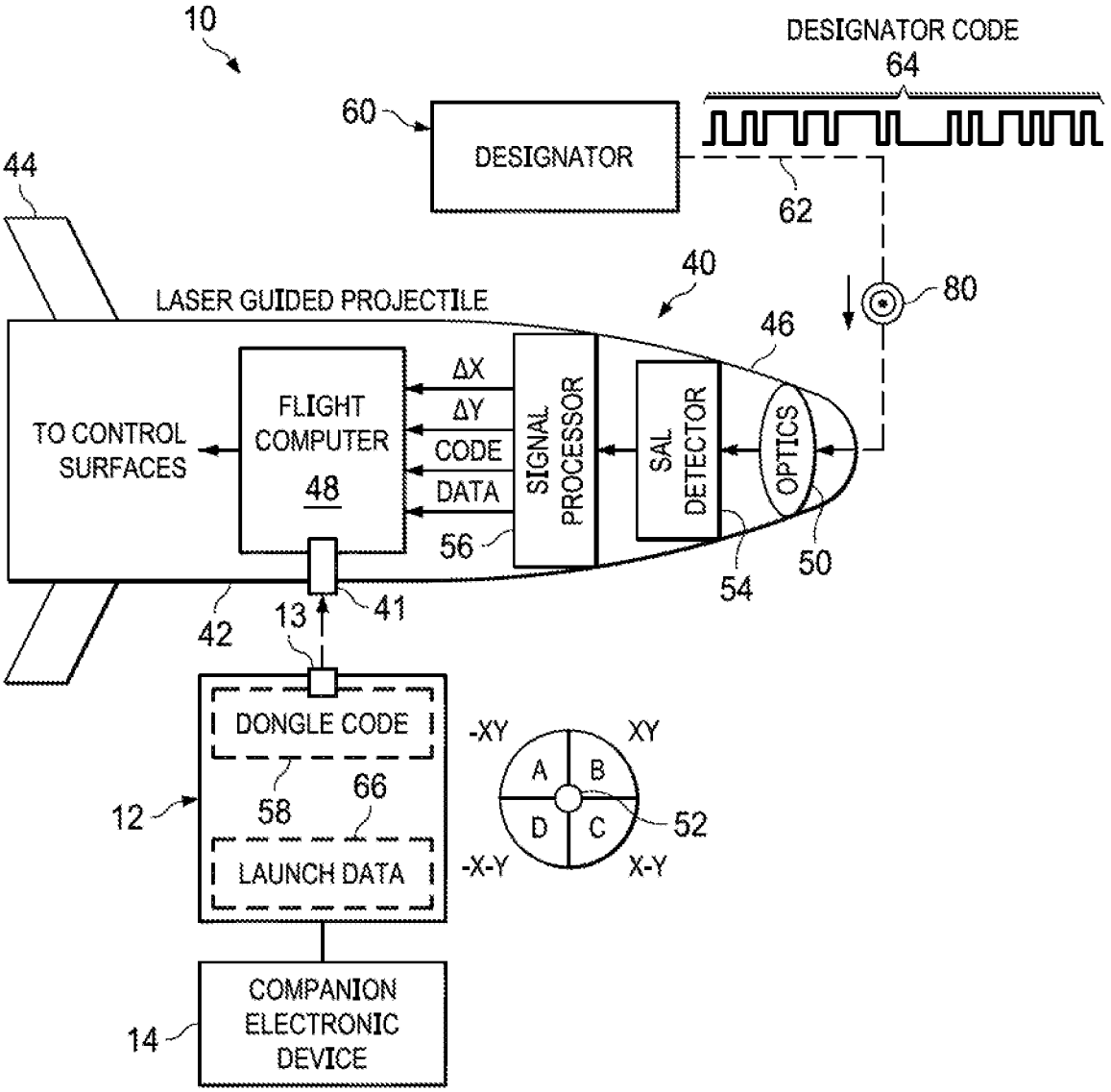
FIGS. 1A through 1C illustrate an example missile system in accordance with this disclosure.

FIGS. 1A through 3, described below, and the various embodiments used to describe the principles of the present disclosure are by way of illustration only and should not be construed in any way to limit the scope of this disclosure. Those skilled in the art will understand that the principles of the present disclosure may be implemented in any type of suitably arranged device or system.

Pulse repetition frequency (PRF) code technology provides for pinpoint accuracy and has been successfully used by the U.S. armed forces since the 1970s. Applications for PRF coding are often found in air-to-ground weapons, such as in Paveway, Hellfire, and Stormbreaker weapons systems. The tactical use of laser-guided weapons in surface-to-surface combat is relatively new, and there are no known solutions for using laser-guided weapons in ground combat at this time other than U.S. Air Force techniques, which are not designed for use by ground forces. Nevertheless, there is much interest in using laser-guided weapon systems during ground combat. However, existing PRF-code concepts of deployment, communication, and security (while suitable for Air Force deconflicted air-to-ground battlespace designation) cannot be directly applied to modern surface-to-surface warfare. More information about laser-guided weapon procedures can be found in Joint Laser Designation Procedures (JLASER), Joint Publication No. 3-09.1, June 1991 (which is hereby incorporated by reference in its entirety).

Current Air Force PRF code distribution and control procedures are not acceptable for close combat operations for many reasons. For instance, the level of distribution and control may be at much higher levels than needed for smaller ground combat units. Also, ground combat often involves multiple users engaging multiple targets simultaneously within the same engagement area, as opposed to air-to-ground combat that may not have multiple users simultaneously engaging multiple targets in an engagement area. Furthermore, updating codes for ground-based units often needs to occur at a faster rate due to faster tactical dynamics. In addition, there may be a much higher chance of weapons falling into the wrong hands in close combat environments.

As mentioned earlier, the dynamics of ground-to-ground laser-guided weapons applications pose a number of specific challenges that are not present in more traditional air-to-ground laser-guided weapons applications. For example, individual soldiers may require their own individual PRF codes in order to deconflict their weapon designations from other soldiers' weapon designations. One or more PRF codes set on a designator pointed at a specific target need to match one or more PRF codes on a specific weapon for a successful deconflicted engagement. The designation can be made by a soldier firing a laser-guided munition or by another party (in which case the PRF codes need to be agreed upon prior to being issued).

There are several reasons (related to weapon security) that make it necessary or desirable to confidentially maintain the PRF codes of specific users or specific weapons. In order to accommodate multiple weapon deconflictions while maintaining weapon security, each soldier is often issued a custom key with a soldier-specific identification (ID) and at least one PRF code. This data can be programmed into the key prior to field deployment, although it may also be changed in the field during deployment using an application on a companion electronic device. Prior to use, a projectile can be pre-programmed with a soldier-specific ID or a list of soldier-specific IDs. During initialization, for example, a soldier can insert his or her key into the projectile, and the projectile receives the soldier-specific ID and the PRF code(s) from the key and stores them in a memory. The projectile is now user-matched and PRF-coded. A laser designator used by at least one soldier can be set to the same PRF code(s), which are known to the user or "buddy" designator, and the projectile can be fired and attempt to strike whatever target or area is designated using the PRF code(s). Note that a key can be removed and re-used with multiple projectiles, and the key can be pre-programmed with multiple users (such as everyone in a squad). The key may also be reprogrammed in the field using a companion device, such as when current PRF codes are jeopardized and need to be changed. Certain protections are pre-built in the key that can prevent unauthorized use.

This disclosure provides techniques for committing specific weapons or other projectiles to specific users in real-time to deconflict a ground combat battlespace or other environment. As described in more detail below, these techniques permit more flexible PRF code assignments while providing suitable security. These techniques thereby help to overcome limitations of current laser-guided weapon systems through the use of PRF code management and weapon security.

Figure 1B:
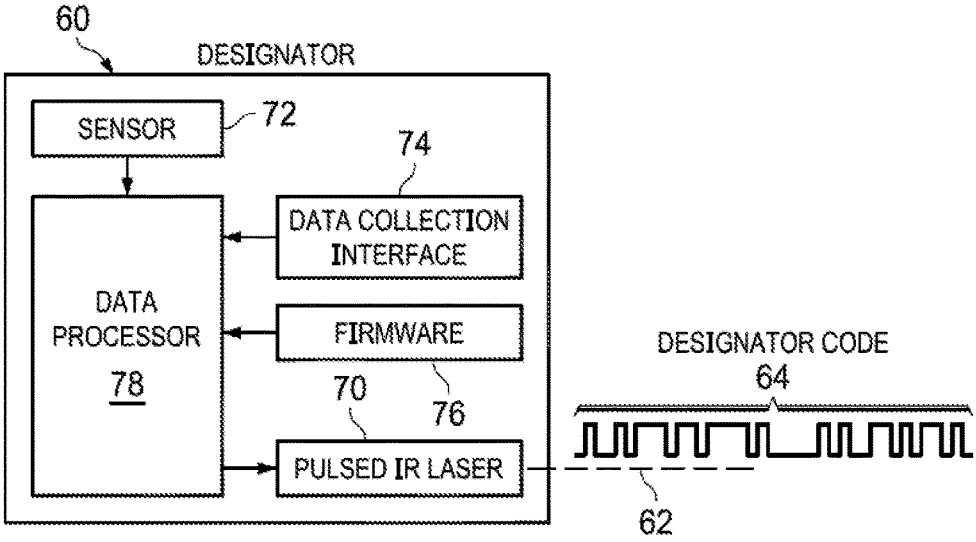
Figure 1C:
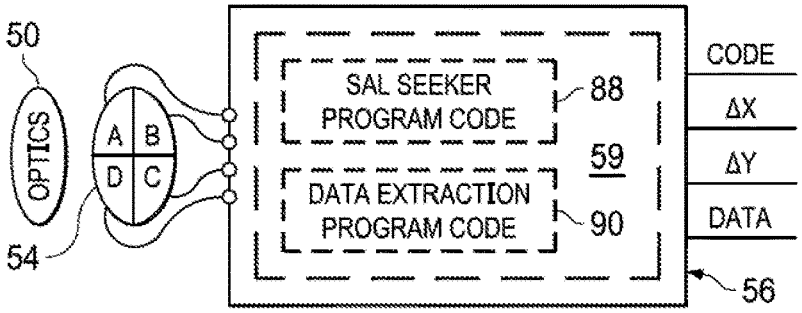

FIGS. 1A through 1C illustrate an example missile system 10 in accordance with this disclosure. In particular, FIG. 1A illustrates the missile system 10, FIG. 1B illustrates a designator 60, and FIG. 1C illustrates a signal processor 56. As shown in FIG. 1A, the missile system 10 here includes a dongle 12, a companion electronic device 14, a laser-guided projectile 40, and a designator 60. The dongle 12 includes a projectile interface 13. The laser-guided projectile 40 includes a projectile body 42, aerodynamic control surfaces 44, a semi-active laser (SAL) seeker 46, and a flight computer 48. Although not shown, the laser-guided projectile 40 may also typically include a fuse assembly and an explosive warhead or other payload. The SAL seeker 46 includes receiver optics 50 that capture and direct PRF-coded infrared (IR) laser electromagnetic radiation (EMR) to form a laser spot 52 on a SAL detector 54, which in turn generates one or more signals. The signal processor 56 executes computer-readable program code 59 to process the one or more signals, extract information from the PRF code, and generate one or more guidance signals (such as ΔX and ΔY signals) indicative of the position of the laser spot on the SAL detector 54. The flight computer 48 processes the information and the guidance signal(s) in order to control the flight of the laser-guided projectile 40.

In some embodiments, the SAL detector 54 may include four quadrants A, B, C, D (although other detector configurations may be used). Each quadrant produces a corresponding signal A, B, C, D in response to the laser power in the laser spot 52 incident upon that quadrant. The guidance signal ΔX indicates an imbalance between the laser power incident upon the left (quadrants A and B) and right (quadrants C and D) halves of the SAL detector 54, and the guidance signal ΔY indicates an imbalance between the laser power incident upon the top (quadrants A and C) and bottom (quadrants B and D) halves of the SAL detector 54. In some cases, the SAL detector 54 may include an A/D converter that converts analog signals to digital signals. Note that the terms "left", "right", "top", and "bottom" here refer to the detector and do not imply any physical orientation within the projectile 40. When the laser spot 52 is centered on the SAL detector 54, the signals A, B, C, D may be essentially equal, and the guidance signals ΔX and ΔY may both be zero or nearly zero.

The position of the SAL seeker 46 may be fixed within the projectile 40, which may be referred to as "body fixed." For example, the SAL seeker 46 may be disposed within the projectile 40 such that an optical axis of the SAL seeker 46 is aligned with a longitudinal axis of the projectile 40. In this case, the laser spot 52 may be centered on the SAL detector 54 when the longitudinal axis of the projectile 40 is pointed directly at a designated target 80. In other cases, the SAL seeker 46 may be mounted on a gimbal or other structure within the projectile 40 such that the optical axis of the SAL seeker 46 can be rotated with respect to the longitudinal axis of the projectile 40. In those cases, the laser spot 52 may be centered on the SAL detector 54 when the optical axis of the SAL seeker 46 is pointed directly at a designated target 80 without the longitudinal axis of the projectile 40 necessarily being pointed directly at the designated target 80.

In a pre-launch mode, the laser-guided projectile 40 can use a dongle code 58 loaded from the dongle 12 in order to be initialized. In some embodiments, the flight computer 48 of the laser-guided projectile 40 is programmed to not launch without the dongle code 58 or to not launch while the dongle code 58 is not stored on the laser-guided projectile 40. The projectile interface 13 of the dongle 12 can be inserted into the dongle interface 41, and the dongle 12 is a portable storage medium that interfaces with the laser-guided projectile 40. The dongle 12 is programmed to store at least one PRF code or dongle code 58 for the laser-guided projectile 40. One or more dongle codes 58 on the dongle 12 are matched to one or more designator codes 64 emitted from one or more designators 60 that mark one or more targets 80. In some embodiments, the dongle 12 can be designed for use by a gloved hand and in field environments. Also, in some embodiments, the dongle 12 can be used on all counter communications system (CCS) weapons.

The projectile interface 13 and the dongle interface 41 may represent physical and electrical interfaces that can be exclusive to the projectile interface 13 of the dongle 12 and the dongle interface 41 of the projectile 40. Also, in some embodiments, the dongle 12 can be programmed for use with a limited number of projectiles or authorized initializations. For example, a dongle 12 can be limited to initializing five laser-guided projectiles 40. The amount of initializations for a dongle 12 can be programmed prior to deployment, wirelessly updated, or programmed using the companion electronic device 14. Further, in some embodiments, the dongle 12 can be programmed for use during a limited amount of time. For instance, a dongle 12 can be limited to initializing laser-guided projectiles 40 within a twelve-hour time span. The amount of authorized time for a dongle 12 can be programmed prior to deployment, wirelessly updated, or programmed using the companion electronic device 14. In addition, in some embodiments, the dongle 12 can be encrypted using a military-level encryption.

In some embodiments, the dongle 12 may require personal authentication during setup. For example, the personal authentication may represent a pin code or other code that is entered prior to or after inserting the dongle 12 into the projectile 40. In particular embodiments, the pin code or other code can be entered from the companion electronic device 14 while the dongle 12 is operatively coupled to the companion electronic device 14. The personal authentication can also or alternatively include native authentications on the companion electronic device 14 or the dongle 12. The personal authentication can include any suitable type of authentication, such as a thumbprint, eye scan, password, passcode, face scan, or any other method of authentication. In some embodiments, the personal authentication is performed by loading a user-specific ID to the projectile 40. The flight computer 48 can store a list of authorized users and can compare the user-specific ID to the user IDs on the list of authorized users. Once authorization is confirmed, the one or more dongle codes 58 can be automatically loaded into the flight computer 48 to initialize the projectile 40.

The dongle 12 can further include pre-launch data 66, and the pre-launch data 66 can be loaded onto the flight computer 48 using the dongle code 58 so that the flight computer 48 can process or otherwise use the pre-launch data 66. The pre-launch data 66 may include various fields, such as fields for guidance mode (air-to-air, air-to-ground, ground-to-ground, etc.), fuse timing mode (airburst, point detonation, delayed detonation, etc.), fuse detonation mode (blast fragmentation, penetration, etc.), range to target, target location, lock mode (lock on before launch, lock on after launch, etc.), or atmospheric conditions (temperature, wind, humidity, etc.). The dongle 12 may include actual data or indices to data tables stored within the flight computer 48.

In a launch mode, a laser designator 60 illuminates a target 80 with a PRF-coded laser beam 62. The laser-guided projectile 40 is pointed at the target 80 to acquire the laser EMR scattered from the target 80 and lock on before launch or reorient during or after launch. Once locked, the projectile is fired or reoriented and ideally travels to or near the target 80 and detonates. The scattered EMR in the seeker's field-of-view is captured and formed into a spot on the SAL detector 54, which in turn generates one or more (such as four) guidance signals. The signal processor 56 executes a portion of the program code 59 that extracts the designator code 64 from the PRF-coded laser beam 62 and generates one or more guidance signals indicative of the position of the laser spot 52 on the SAL detector 54. The flight computer 48 verifies the designator code 64, calculates a bearing or flight path to the target 80 from the guidance signals, and issues control signals to control the aerodynamic control surfaces 44 in order to guide the projectile 40 to the target 80.

In some embodiments, the target 80 and the PRF-coded laser beam 62 are out of sight from a launch location of a projectile 40. In these instances, a proxy designator 60 is used to illuminate a target 80. For example, the proxy designator 60 may be installed on an unmanned aerial vehicle (UAV) flying within a projectile range or a separate designator 60 with a "forward operator," such as a scout. In these cases, the projectile 40 can be launched in the general direction of the target 80. While in flight, the projectile 40 scans the ground for the reflected PRF coded laser beam 62 with a matching designator code 64 that is illuminating the target 80. Once the target 80 is identified, the projectile 40 can adjust course and proceed to the target 80.

When multiple designators 60 are deployed, the flight computer 48 can monitor different PRF encoded laser beams 62 that are projected onto different targets 80. The designator codes 64 from the different PRF encoded signals can each be compared to the dongle code(s) 58 loaded from the dongle 12. When a designator code 64 from one of the PRF laser beams 62 matches the dongle code(s) 58 loaded from the dongle 12, the flight computer 48 can identify the target 80 and adjust a flight path to the target 80. The deconfliction of the battlespace is a responsibility of the operators.

The flight computer 48 receives the designator code(s) 64 read from the PRF encoded laser beam(s) 62 and compares the designator code(s) 64 with the dongle code(s) 58 loaded from the dongle 12. When a designator code 64 matches a dongle code 58, the flight computer 48 adjusts the flight path of the laser-guided projectile 40. In some embodiments, the designator code 64 can include a four-digit code. In particular embodiments, the four-digit code is programmed into the designator 60 and the dongle 12 prior to deployment. The four-digit code can be unique for a dongle 12. However, multiple codes can be loaded onto the dongle 12 to associate the dongle 12 with different designators 60. While multiple codes may be loaded onto the dongle 12 before deployment, only a single dongle code 58 may loaded into a flight computer 48 in some embodiments. A default dongle code 58 can be set that is associated with the operator and/or specific designator 60. In order to change the dongle code 58 that is loaded to the flight computer 48, an alternate dongle code 58 can be selected, such as on an interface of the dongle 12 or the companion electronic device 14. The default dongle code 58 may be used in situations where an alternate dongle code 58 has not been selected.

In some embodiments, an operator can be issued a secured companion electronic device 14. The companion electronic device 14 can be used to change the dongle code 58 prior to or during deployment, such as by entering a new four-digit code on the companion electronic device 14. The companion electronic device 14 can also be used to select a specific dongle code 58 from a list of codes preloaded onto the dongle 12 before deployment. The companion electronic device 14 can further communicate with the dongle 12 through a compatible interface, over a wired connection, and over a wireless connection.

Note that once the laser-guided projectile 40 is initialized, the dongle 12 can be removed. In this way, the dongle code 58 on the dongle 12 can be used for different or multiple laser-guided projectiles 40.

As shown in FIG. 1B, an embodiment of the designator 60 includes a pulsed IR laser 70, one or more sensors 72 for acquiring data, a data collection interface 74 for acquiring data, firmware 76, and a data processor 78 that processes the acquired data to generate the designator codes 64 in order to modulate the pulsed IR laser 70 and generate the PRF-coded laser beam 62. The pulsed IR laser 70 may include a laser diode, a light emitting diode (LED), or a higher power laser such as used in a laser range finder (LRF) or laser designator. The sensors 72 may include environment sensors to acquire atmospheric data, such as wind speed and direction, temperature, pressure humidity etc. The sensors 72 may also include an LRF to provide range-to-target and a Global Positioning System (GPS) or other positioning receiver to provide a position of the target. The data collection interface 74 may include a numeric keypad, graphical user interface (GUI), or other interface for data entry or mode selection by the user, a port (hardwired or wireless) to receive data from a computer, or one or more ports to receive data from an LRF or positioning receiver that is not part of the device's sensor package. The firmware 76 can provide reprogramming and software updates for the projectile and detonation mode inputs. The data processor 78 formats the designator code 64 into fields expected by the program code in the SAL seeker 46.

FIG. 1C depicts an example of program code blocks of an embodiment of the signal processor 56. In this example, the signal processor 56 stores computer readable program code 59 in memory and executes the code to extract PRF-coded information (device or designator codes) from the detected EMR and to generate the guidance signals ($\Delta X$, $\Delta Y$). Logic circuitry and a technique for decoding a PRF-coded beam is described in U.S. Pat. Nos. 5,023,888 and 5,026,156 (which are hereby incorporated by reference in their entirety).

Functionally, the program code 59 implements first and second difference circuits that generate the guidance signal $\Delta X$ as an imbalance between the laser power incident upon the left (quadrants A and B) and right (quadrants C and D) halves of the detector and the guidance signal $\Delta Y$ as an imbalance between the laser power incident upon the top (quadrants B and C) and bottom (quadrants A and D) halves of the detector. The program code 59 also implements a summing circuit that sums the signals generated by the A, B, C and D quadrants into a single PRF-coded signal and a signal demodulator that extracts the designator code 64 and any additional data. In some embodiments, the existing SAL seeker 46 may include SAL seeker program code 88 that performs the guidance functions of extracting the designator code 64 and generating the ΔX, ΔY guidance signals. Data extraction program code 90 can be loaded into the signal processor's memory to upgrade the SAL seeker 46 in order to provide a communication interface that extracts extra data from the PRF-coded beam and provides the data to the flight computer 48.

Although FIGS. 1A through 1C illustrate one example of a missile system 10, various changes may be made to FIGS. 1A through 1C. For example, the sizes, shapes, and dimensions of the missile system 10 and its individual components can vary as needed or desired. Also, the number and placement of various components of the missile system 10 can vary as needed or desired. In addition, the described techniques for coordinating PRF codes may be used in any other suitable laser-based application and are not limited to use with missile systems.

Figure 2:
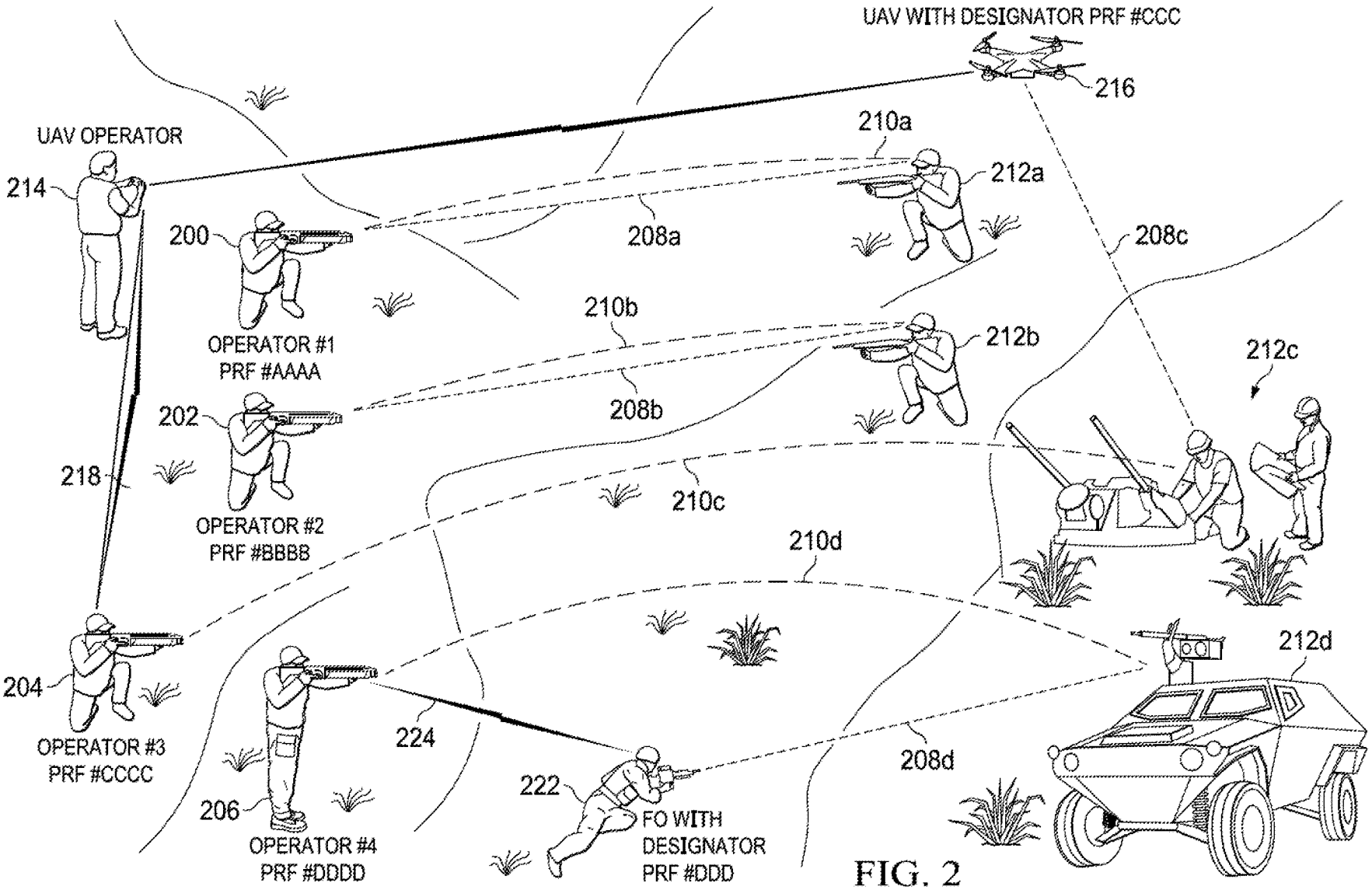
FIG. 2 illustrates example uses of dongles with missiles or other projectiles in accordance with this disclosure.

FIG. 2 illustrates example uses of dongles 12 with missiles or other projectiles in accordance with this disclosure. As shown in FIG. 2, soldiers 200 and 202 are both deployed in a general area at the same time. The soldiers 200 and 202 also have their designators 60 set to their specific issued designator codes 64 (AAAA and BBBB, respectively) that match their pre-programmed dongle codes 58. When ready to engage, the soldier 200 or 202 may insert the dongle 12 into a projectile 40. The projectile 40 recognizes the dongle 12 as authorized, and the dongle code 58 is automatically loaded into the laser-guided projectile 40, such as during part of the initialization of the projectile 40. A failed authentication prevents the projectile 40 from initialization (per communications security or "ComSec" protocols). The soldier 200 or 202 can fire "at-will" once the dongle code 58 has been loaded into the projectile 40. Once the projectile 40 is launched, the soldier 200 or 202 can continue to designate targets 80, therefore guiding specific projectiles 40 to specific targets 80. In some cases, because the operator's dongles 12 can be authenticated to all squad projectiles 40, projectile sharing between operators is possible, meaning any squad projectile 40 can be operated with any squad dongle 58 (as long as the dongle codes 58 match the designator codes 64).

Once the first target 212*a* is identified, the soldier 200 inserts his or her dongle 12 into a first projectile 210*a*. The flight computer 48 of the first projectile 210*a* has authorization information loaded prior to deployment. The flight computer 48 compares the pre-loaded authorization information with authorization information loaded on the dongle 12. In some embodiments, the pre-loaded authorization information in the flight computer 48 is compared to authorization information on a companion electronic device 14 issued to the soldier 200 prior to deployment. In this manner, if the dongle 12 or companion electronic device 14 was recovered by enemy combatants or one of the targets, the dongle 12 or companion electronic device 14 can remotely have the authorization removed. For example, the soldier 202 may notice that the companion electronic device 14 or the dongle 12 related to the first soldier 200 has been compromised, such as through capture, death, injury, retreat, etc. of the soldier 200. The soldier 202 can relay the information over a companion electronic device 14 back to base, and the base can wirelessly deactivate the companion electronic device 14 of the soldier 200.

Once the dongle 12 is authorized, the dongle code 58 (AAAA) is loaded into the flight computer 48, and the first projectile 210*a* is initialized. The first projectile 210*a* can be launched when suitable to the soldier 200. The designator 60 emits a first PRF-coded laser beam 208*a* encoded with the designator code 64 (AAAA) that matches the dongle code 58 (AAAA). As a result, the first projectile 210*a* travels to the first target 212*a* based on the first PRF-coded laser beam 208*a* including a matching designator code 64 (AAAA).

Once the second target 212*b* is identified, the soldier 202 inserts his or her dongle 12 into a second projectile 210*b*. The same process described above with reference to the first projectile 210*a* may occur in the second projectile 210*b*. Once the dongle 12 is authorized, the dongle code 58 (BBBB) is loaded into the flight computer 48, and the second projectile 210*b* is initialized. The second projectile 210*b* can be launched when suitable to the soldier 202. The designator 60 for the soldier 202 emits a second PRF-coded laser beam 208*b* encoded with a designator code 64 (BBBB) that matches the dongle code 58 (BBBB), which is coupled into the projectile's SAL seeker 46. The second projectile 210*b* travels to the second target 212*b* based on the second PRF-coded laser beam 208*b*.

In some cases, both the first PRF-coded laser beam 208*a* and the second PRF-coded laser beam 208*b* are simultaneously projected at one or more targets 80 in a general area within an optic field of view for a projectile 40. When this occurs, the first projectile 210*a* and the second projectile 210*b* can travel to the correct targets based on the designator code 64 (AAAA and BBBB, respectively) matching the respective dongle code 58 (AAAA and BBBB, respectively).

A soldier 204 can receive a communication 218 from a soldier 214 that a third target 212*c* is identified using a UAV 216 including a designator 60. For example, the soldier 214 may be an operator of the UAV 216 and may perform scouting functions for the soldiers 200-206. The soldier 214 can identify the third target 212*c* that is out of view from the soldiers 200-206, such as through optical sensors installed on the UAV 216. The soldier 214 can communicate 218 with the soldier 204 to initialize and launch a third projectile 210*c*. At this point, the soldier 214 can transmit a dongle code 58 (CCCC) to the dongle 12 or companion electronic device 14 of the soldier 204. In some embodiments, this transmission may identify which dongle code 58 (CCCC) to use in conjunction with the designator 60 on the UAV 216. In some embodiments, the soldier 214 can transmit the dongle code 58 (CCCC) corresponding to the dongle 12 of the soldier 204 to the UAV 216. The UAV 216 can emit a third PRF-coded laser beam 208*c* encoded with a designator code 64 (CCCC) that matches the dongle code 58 (CCCC) for the third projectile 210*c*.

The UAV 216 uses a laser designator to paint the third target 212*c* with a third PRF-coded laser beam 208*c*. The soldier 204 can aim the third projectile 210*c* in the direction of the third target 212*c* and launch the third projectile 210*c*. While in flight, the third projectile 210*c* monitors the ground to acquire the scatter EMR including the designator code 64 (CCCC) corresponding to the loaded dongle code 58 (CCCC). The flight computer 48 verifies the designator code 64 (CCCC) by matching it to the dongle code 58 (CCCC) and reorients the third projectile 210*c* towards the scatter EMR with the matching designator code 64 (CCCC). The UAV 216 holds the third PRF-coded laser beam 208*c* on the third target 212*c* until impact, and the SAL seeker 46 locks onto and tracks the position of the spot. The flight computer 48 processes the guidance signals provided by the SAL seeker 46 to control the aerodynamic surfaces and direct the third projectile 210*c* to impact the painted third target 212*c*.

A designator soldier 222 can be a scout for soldiers 200-206 at a forward elevated position, and the designator soldier 222 can identify a fourth target 212*d*. Because the designator soldier 222 is separated from other soldiers 200-206, the soldier 222 firing on the fourth target 212*d* would expose the forward elevated position and may compromise the soldier 222. In order to not expose the designator soldier 222 to enemy combatants, the designator soldier 222 can transmit a signal 224 to coordinate firing on the fourth target 212*d* with the soldier 206. At this point, the soldier 222 can transmit a dongle code 58 (DDDD) to the dongle 12 or companion electronic device 14 of the soldier 206 that corresponds to the designator code 64 (DDDD) of the designator 60 with the soldier 222. In some embodiments, this transmission may identify which dongle code 58 (DDDD) to use for the fourth projectile 210*d* in conjunction with the designator code 64 (DDDD) of the designator 60 with the soldier 222. The designator 60 of the soldier 222 emits a fourth PRF-coded laser beam 208*d* encoded with a designator code 64 (DDDD) that matches the dongle code 58 (DDDD) for the fourth projectile 210*d*.

The designator soldier 222 uses a laser designator to paint the fourth target 212*d* with a fourth PRF-coded laser beam 208*d*. The soldier 206 can aim the fourth projectile 210*d* in the direction of the fourth target 212*d* and launch the fourth projectile 210*d*. While in flight, the fourth projectile 210*d* monitors the ground to acquire the scatter EMR including the designator code 64 (DDDD) corresponding to the loaded dongle code 58 (DDDD). The flight computer 48 verifies the designator code 64 (DDDD) by matching it to the dongle code 58 (DDDD) and reorients the fourth projectile 210*d* toward the scatter EMR including the designator code 64 (DDDD). The soldier 222 holds the fourth PRF-coded laser beam 208*d* on the fourth target 212*d* until impact, and the SAL seeker 46 locks onto and tracks the position of the spot. The flight computer 48 processes the guidance signals provided by the SAL seeker 46 to control the aerodynamic surfaces and direct the fourth projectile 210*d* to impact the painted fourth target 212*d*.

Although FIG. 2 illustrates examples of uses of dongles 12 with missiles or other projectiles, various changes may be made to FIG. 2. For example, the sizes, shapes, and dimensions of the components illustrated in FIG. 2 can vary as needed or desired. Also, the number and placement of various components illustrated in FIG. 2 can vary as needed or desired. In addition, the described techniques for coordinating PRF codes may be used in any other suitable laser-based application and are not limited to use with missile systems.

Figure 3:
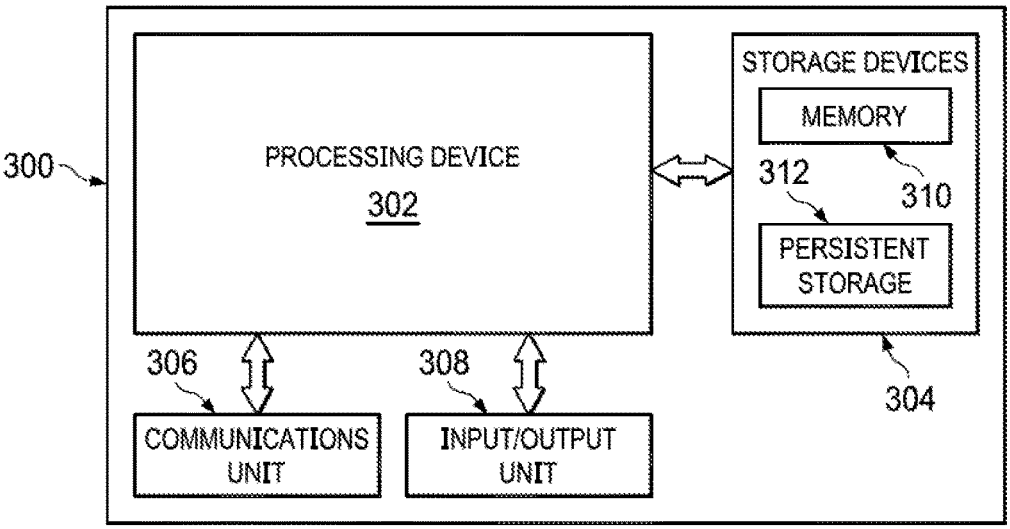
FIG. 3 illustrates an example device for use with projectiles in accordance with this disclosure.

FIG. 3 illustrates an example device 300 for use with projectiles in accordance with this disclosure. One or more instances of the device 300 (or portions thereof) may, for example, be used to at least partially implement the functionality of the dongle 12, the designator 60, the flight computer 48, and the companion electronic device 14 of FIGS. 1A-1C. However, the functionality of the dongle 12, the designator 60, the flight computer 48, and the companion electronic device 14 may be implemented in any other suitable manner.

As shown in FIG. 3, the device 300 denotes a computing device or system that includes at least one processing device 302, at least one storage device 304, at least one communications unit 306, and at least one input/output (I/O) unit 308. The processing device 302 may execute instructions that can be loaded into a memory 310. The processing device 302 includes any suitable number(s) and type(s) of processors or other devices in any suitable arrangement. Example types of processing devices 302 include one or more microprocessors, microcontrollers, digital signal processors (DSPs), application-specific integrated circuits (ASICs), field programmable gate arrays (FPGAs), or discrete circuitry.

The memory 310 and a persistent storage 312 are examples of storage devices 304, which represent any structure(s) capable of storing and facilitating retrieval of information (such as data, program code, and/or other suitable information on a temporary or permanent basis). The memory 310 may represent a random access memory or any other suitable volatile or non-volatile storage device(s). The persistent storage 312 may contain one or more components or devices supporting longer-term storage of data, such as a read only memory, hard drive, Flash memory, or optical disc.

The communications unit 306 supports communications with other systems or devices. For example, the communications unit 306 can include a network interface card or a wireless transceiver facilitating communications over a wired or wireless network. The communications unit 306 may support communications through any suitable physical or wireless communication link(s).

The I/O unit 308 allows for input and output of data. For example, the I/O unit 308 may provide a connection for user input through a keyboard, keypad, touchscreen, or other suitable input device. The I/O unit 308 may also send output to a display or other suitable output device. Note, however, that the I/O unit 308 may be omitted if the device 300 does not require local I/O, such as when the device 300 can be accessed remotely or operated autonomously.

In some embodiments, the instructions executed by the processing device 302 can include instructions that implement all or portions of the functionality of the dongle 12, the companion electronic device 14, the flight computer 48, or the designator 60 described above. For example, the instructions executed by the processing device 302 can include instructions for coordinating PRF codes in laser-guided weapon applications as described above or other applications.

Although FIG. 3 illustrates one example of a device 300 for use with projectiles, various changes may be made to FIG. 3. For example, computing devices and systems come in a wide variety of configurations, and FIG. 3 does not limit this disclosure to any particular computing device or system.

In some embodiments, various functions described in this patent document are implemented or supported by a computer program that is formed from computer readable program code and that is embodied in a computer readable medium. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive (HDD), a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable storage device.

It may be advantageous to set forth definitions of certain words and phrases used throughout this patent document.

The terms "application" and "program" refer to one or more computer programs, software components, sets of instructions, procedures, functions, objects, classes, instances, related data, or a portion thereof adapted for implementation in a suitable computer code (including source code, object code, or executable code). The term "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

The description in the present disclosure should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," or "controller" within a claim is understood and intended to refer to structures known to those skilled in the relevant art, as further modified or enhanced by the features of the claims themselves, and is not intended to invoke 35 U.S.C. § 112(f).

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A method comprising:

loading an operator code into a memory of a laser-guided projectile, wherein the laser-guided projectile is configured to be guided by a laser pulsed according to a pulse repetition frequency (PRF) code, and wherein the operator code contains authentication information of an authorized operator of the laser-guided projectile;

removably coupling a projectile interface of a dongle associated with the authorized operator of the laser-guided projectile to a dongle interface of the laser-guided projectile, wherein the dongle includes a dongle code identifying the PRF code of a guidance laser to be recognized and followed by the laser-guided projectile;

authorizing the operator code by associating the dongle with the authorized operator of the laser-guided projectile; and in response to the laser-guided projectile authorizing the operator code, loading the dongle code from the dongle onto the laser-guided projectile to switch the laser-guided projectile to a ready to fire state.

2. The method of claim 1, further comprising:

matching, by a flight computer of the laser-guided projectile, the dongle code with a designator code detected in a laser signal from a designator to guide the laser-guided projectile.

3. The method of claim 1, wherein the dongle code is unique to the authorized operator of the laser-guided projectile.

4. The method of claim 1, wherein authorizing the operator code comprises performing a native authentication including at least one of a thumbprint, an eye scan, a password, a passcode, or a face scan.

5. The method of claim 1, further comprising:

limiting a number of uses of the dongle code with different laser-guided projectiles.

6. The method of claim 1, further comprising:

limiting an amount of time for using the dongle code.

7. The method of claim 1, wherein a companion electronic device is used to authenticate the dongle.

8. A projectile assembly comprising:

a laser-guided projectile comprising a dongle interface; and a dongle comprising:

a projectile interface configured to be removably coupled to the dongle interface;

a memory containing a dongle code identifying a pulse repetition frequency (PRF) code of a guidance laser to be recognized and followed by the laser-guided projectile; and a processor configured to:

prior to loading the dongle code from the dongle onto the laser-guided projectile, load an operator code onto the laser-guided projectile, wherein the operator code contains authentication information of an authorized operator of the laser-guided projectile; and in response to the laser-guided projectile authorizing the operator code, load the dongle code from the dongle onto the laser-guided projectile to switch the laser-guided projectile to a ready to fire state.

9. The projectile assembly of claim 8, wherein the laser-guided projectile is configured to match the dongle code with a designator code detected in a laser signal from a designator to guide the laser-guided projectile.

10. The projectile assembly of claim 8, wherein the dongle code is unique to the authorized operator of the laser-guided projectile.

11. The projectile assembly of claim 8, wherein, to authorize the operator code, the laser-guided projectile is configured to perform a native authentication including at least one of a thumbprint, an eye scan, a password, a passcode, or a face scan.

12. The projectile assembly of claim 8, wherein the dongle code has a limited number of uses with different laser-guided projectiles.

13. The projectile assembly of claim 8, wherein the dongle code has a limited amount of time for use with the laser-guided projectile.

14. The projectile assembly of claim 8, wherein the laser-guided projectile is configured to communicate with a companion electronic device to authenticate the dongle.

15. The projectile assembly of claim 8, wherein the laser-guided projectile comprises a missile.

16. A dongle comprising:

a projectile interface configured to be removably coupled to a dongle interface of a laser-guided projectile;

a memory containing a dongle code identifying a pulse repetition frequency (PRF) code of a guidance laser to be recognized and followed by the laser-guided projectile; and a processor configured to:

prior to loading the dongle code from the dongle onto the laser-guided projectile, load an operator code onto the laser-guided projectile, wherein the operator code contains authentication information of an authorized operator of the laser-guided projectile; and in response to the laser-guided projectile authorizing the operator code, load the dongle code from the dongle onto the laser-guided projectile to switch the laser-guided projectile to a ready to fire state.

17. The dongle of claim 16, wherein the dongle code is unique to the authorized operator of the laser-guided projectile.

18. The dongle of claim 16, wherein the laser-guided projectile is configured to perform a native authentication including at least one of a thumbprint, an eye scan, a password, a passcode, or a face scan.

19. The dongle of claim 16, wherein the dongle code has a limited number of uses with different laser-guided projectiles.

20. The dongle of claim 16, wherein the dongle code has a limited amount of time for use with the laser-guided projectile.

* * * * *